US005425486A

United States Patent [19]

Kurker

[11] Patent Number: 5,425,486

[45] Date of Patent: Jun. 20, 1995

[54] WRAP DISPENSER WITH COMPRESSIBLE SUPPORT

[76] Inventor: George K. Kurker, 97 Alcott Rd., East Falmouth, Mass. 02536

[21] Appl. No.: 140,853

[22] Filed: Oct. 25, 1993

[51] Int. Cl.[6] ..... B26F 3/02

[52] U.S. Cl. ..... 225/46; 225/51; 225/76

[58] Field of Search ..... 225/46, 76, 51, 49

[56] References Cited

U.S. PATENT DOCUMENTS

| | | | |
|---|---|---|---|
| 392,790 | 11/1888 | Ehrlich | 225/76 |
| 1,977,187 | 10/1934 | Katz | 225/76 |
| 2,834,646 | 5/1958 | Berg | 225/51 |
| 3,407,980 | 10/1968 | Addison | 225/76 |
| 3,949,947 | 4/1976 | Youngquist et al. | 225/51 |
| 4,130,228 | 12/1978 | Perrin | 225/49 |
| 4,919,350 | 4/1990 | Miller | 225/51 |

*Primary Examiner*—Kenneth E. Peterson
*Attorney, Agent, or Firm*—Thomas A. Kahrl

[57] ABSTRACT

A portable dispenser for a roll of sheet material comprising an enclosure of rectangular shape having a rear wall, bottom wall, having a free forward edge and a cover having a rear edge hingedly mounted to the rear wall being movable between an open position and a closed position for an open position for insertion of a roll of dispensing sheet material and a closed position for dispensing sheet material including a front cutting edge and including a compressible support for supporting the roll of sheet material by compressing when the full roll is inserted and gradually expanding when the material is utilized thereby raising the roll upward and frontward toward the dispensing area of the box, including the cutting edge, said compressible support being fixed to the interior of the box, whereby frictional resistance of the sponge also diminishes reverse rolling of the roll and the resultant pulling back of the leading edge of the sheet material wherein the cutting edge is held close to the parting segment of the roll of the material for the reason the position of the roll of sheet material is controlled by the compressible support.

1 Claim, 1 Drawing Sheet

WRAP DISPENSER WITH COMPRESSIBLE SUPPORT

REFERENCE TO PRIOR DISCLOSURE DOCUMENT

This application incorporates Disclosure Document No. 328019 filed Mar. 25, 1993 which is incorporated herein by reference.

BACKGROUND OF THE INVENTION

This invention relates to a portable container for dispensing sheet material such as continuous plastic sheets from a roll of sheet material contained in a rectangular box. Currently, a widely used wrap dispenser consists of a long, continuous sheet of wrap material in the form of a roll of wax paper, cellophane, aluminum foil, etc., loosely positioned in a box container having a cutting edge, wherein the sheet is pulled out to the proper length and then cut by creasing it against the cutting edge. This system is awkward in that the desired length is usually misjudged, or the sheet is not cut square, or is frequently torn on a jagged edge due to the uncontrolled erratic movement of the loose roll as it spins in the box.

In particular, a common problem is that the edge of the sheet of film consisting of plastic wrap, such as "Saran Wrap" ® clings to the roll after cutting and must be repeeled or restarted causing loss of time, material, as well as patience.

Applicant is aware of other prior art devices which are adapted to dispense sheet-like members from a roll, rotably mounted in fixed relation in a container, such as is disclosed in U.S. Pat. No. 5,222,644 issued Jun. 29, 1993, which seeks to control the "cling effect" by wall-mounting the container and positioning the roll in fixed relation thereto such that the sheet material depends in hanging fashion adjacent the cutting edge.

Accordingly, it is desirable to provide for a new and improved portable wrap dispensing unit for consistent and controlled delivery of a filmed sheet or sheet-like member from a box-like container, to provide for greater ease in use, increased economy, and which overcomes at least some of the disadvantages of prior art dispensers.

SUMMARY OF THE INVENTION

The present invention is directed to a wrap dispenser including a roll of continuous sheet material positioned in a portable container having a cutting edge attached to a moveable top for selectively cutting the sheet material to length, including a moveable support for controlled positioning of the roll with respect to the cutting edge.

This novel packaging and dispensing device for household rolls of plastic wrap, waxed paper, aluminum foil and other rolled and packaged products such as gift wrapping, shelving paper, etc., mitigates the typical problems encountered as the roll of sheet material upon use, diminishes in diameter and weight; i.e., the roll is lifted upward and forward as the material is withdrawn and dispensed; then drops downward and backward after the drawn sheet material is torn on the conventional serrated cutting edge, thereafter retracting a resulting leading edge of the material away from the desired "dispensing" position; especially with respect to plastic wrap such that the leading edge drapes over and clings to the remaining roll, thereby necessitating the re-peeling and restarting of a new leading edge from the roll virtually each time the dispenser is used.

This novel packaging and dispensing device contemplates the affixation (by gluing or tacking) of the movable support, constructed of a resilient synthetic sponge-like material, approximately ½" thick, extending lengthwise along the inside bottom and back of the container. This movable support is constructed to compress when a full roll is initially loaded in the container; and gradually expands as the sheet material is dispensed, thereby urging the roll upward and frontward toward the dispensing area of the box. The friction resistance of the surface of the sponge-like material, also diminishes reverse-rolling of the roll as the expanding sponge material prevents the troublesome dropping back of the roll with the resulting pulling back of the leading edge of the material.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
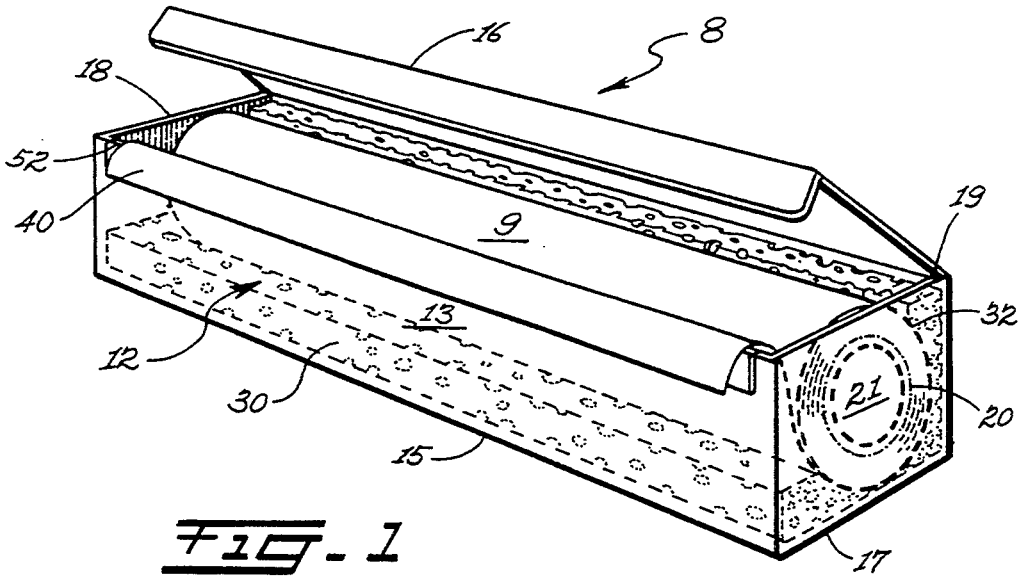
FIG. 1 is an illustrated, perspective view from above of the wrap dispenser with movable support of the invention with the top open and a the leading edge of the wrap in the dispensing position.
Figure 2:
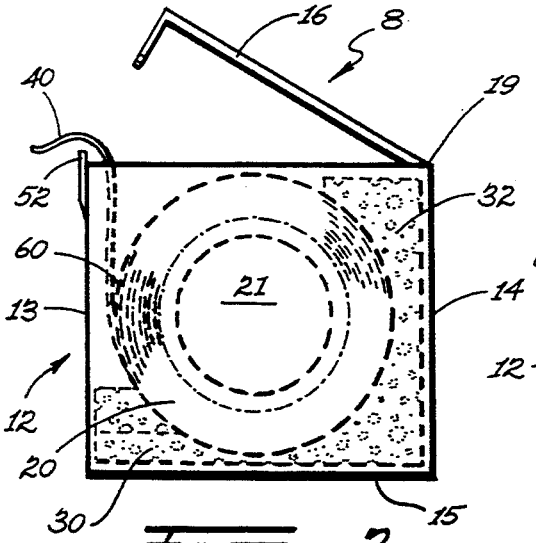
FIG. 2 is a side cross-sectional view at the line 2—2 of the wrap dispenser of FIG. 1 showing a nearly empty roll and the movable support in the raised forward position.
Figure 3:
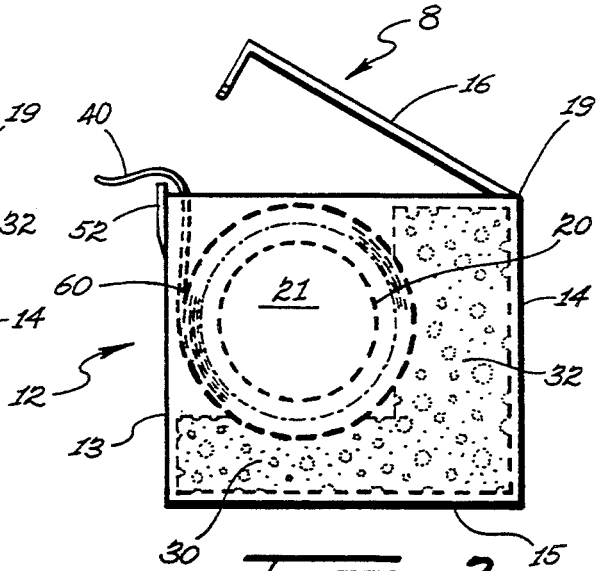
FIG. 3 is a side cross sectional view of the invention of FIG. 2 showing the movable support in the compressed full position in combination with a full roll loaded in the container.

Referring to FIGS. 1–3, there is shown a wrap dispenser 8 including a roll of wrap 9 positioned on a movable support 10 positioned in a container 12. The container 12 is a hollow rectangular body, i.e., it is bounded or formed by straight lines, including rectangular walls 13, 14, and bottom, 15, and including movable top 16 and having end side walls 17 and 18, which have a substantially square cross section.

In the preferred embodiment, a core 21 is disposed within the container 12, and in order to fit said container and provide space for a continuous sheet of wrap material 20, core 21 has a smaller cross-sectional area than the interior side cross sectional area of container 12. As is shown in FIGS. 1, 2, and 3, the movable support 10 consisting of 2 rectilinear bodies 30 and 32 joined together in orthogonical relationship extending along substantially the entire length of the container 12. The top 16 of said container includes a longitudinal hinge 19 permitting movement between a closed position and a raised dispensing position providing an area of egress for passage of a segment of sheet material 20 wrapped on the core 21.

In the preferred embodiment, the movable support 10 is constructed of resilient sponge-like material having a thickness of approximately ½", which extends lengthwise along the inside of bottom 15 and the inside of back wall 14 of container 12.

Egress means 50 affords egress from the interior of the container 12 when top 16 is in the open dispensing position and provides an opening above the front wall 13 on which is disposed a longitudinal extending cutting edge 52. The continuous sheet 20 of the wrap includes a leading edge 40 at the distal end of the sheet material 20 extending outwardly over the cutting edge 52 wherein, as the said sheet material is drawn out, a selected proper length of material is cut by creasing said sheet material against said cutting edge. As is shown in FIGS. 2 & 3, the action of the movable support 17 is to maintain a relatively constant distance between the cutting edge 52 and a parting area 60 of roll 9, by providing controlled positioning of said parting area relative to said cutting edge, and reducing rearward displacement of the leading edge 40 whereby said leading edge is prevented from falling back on top of the roll 9 wherein it would be apt to otherwise cling to said roll after cutting, requiring re-peeling or restarting. Furthermore, in the preferred embodiment, resistance is provided between the surface areas of rectilinear bodies 30 and 32 to the spinning action of the roll of wrapped material 20 due to its sponge like surface area, thereby diminishing reverse rolling of said roll as the rectilinear bodies 30 and 32 expand, thereby preventing troublesome "dropping back" of said roll and the resulting pulling back of leading edge 40 of the material.

What is claimed is:

1. A portable dispenser in combination with a roll of sheet material comprising:

a) a roll of sheet material consisting of an elongated sheet of plastic material having a parting segment at a distal end and a trailing segment at an inner end;

b) an enclosure including a real wall, a front wall having a cutting edge and a cover hingedly mounted to said rear wall movable between an open position for insertion of the roll of sheet material and a closed position for dispensing sheet material; and c) suspension means for supporting said roll so as to maintain a controlled relationship between the parting segment of said roll and the cutting edge of the container consisting of compressible material adapted for compression between an extended position and a compressed position whereby said enclosure forming a sheet material dispensing device wherein the cutting edge is held close to a parting segment of the roll of material, and the position of the roll within the enclosure is controlled by suspension means for maintaining a controlled relationship between the parting segment of the roll and the cutting edge of the container wherein said sheet material consists of plastic polyethylene material and wherein said suspension means comprises a first rectilinear body joined in orthogonal relationship to a second rectilinear body extending along substantially the entire length of the enclosure, said rectinlear bodies constructed of resilient material.

* * * * *